US005496211A

United States Patent [19]

Zimmermann

[11] Patent Number: 5,496,211

[45] Date of Patent: Mar. 5, 1996

[54] DEVICE FOR VERTICALLY CONVEYING COINS

[75] Inventor: Gert Zimmermann, Berlin, Germany

[73] Assignee: F. Zimmermann & Co., Berlin, Germany

[21] Appl. No.: 213,242

[22] Filed: Mar. 14, 1994

[30] Foreign Application Priority Data

Mar. 15, 1993 [DE] Germany ..... 43 08 725.6

[51] Int. Cl.[6] ..... G07D 3/16

[52] U.S. Cl. ..... 453/3; 453/56; 198/607

[58] Field of Search ..... 453/3, 4, 7, 11, 453/56; 198/607, 725; 194/344

[56] References Cited

U.S. PATENT DOCUMENTS

| | | | |
|---|---|---|---|
| 2,286,250 | 6/1942 | Albertoli | 198/725 X |
| 4,681,204 | 7/1987 | Zimmermann | 453/56 X |
| 5,046,989 | 9/1991 | Dass | 194/344 X |
| 5,232,398 | 8/1993 | Maki | 453/56 X |

*Primary Examiner*—F. J. Bartuska
*Attorney, Agent, or Firm*—McGlew and Tuttle

[57] ABSTRACT

A device for vertically conveying coins including a lower horizontal guide path, a vertical guide path, an approximately arc-shaped deflecting path connecting the lower horizontal guide path and the vertical guide path. Each of the path conveys the coins in a lying fiat position. At least one conveyor belt is provided. Rollers are provided whereby the conveyor belt is led around the rollers. Deflecting rollers are arranged at space locations from the guide paths and the from the arc-shaped deflecting path. With this structure, an essentially constant conveying gap is formed by the thickness of the coins being conveyed between the guide paths and the deflecting paths and the conveyor belt. Structure for feeding the coins, conveyed lying flat one by one, is arranged at the beginning of the lower horizontal guide path. Structure for transferring the coins being conveyed is arranged at the top end of the vertical guide path. At the beginning of the lower horizontal guide path there is preferably provided structure for identifying the denomination of the coins and for counting the coins, and or for presorting and conveying the coins according to denomination and/or for sorting out foreign coins. The end of the vertical guide path is formed by a dispenser hood with a coin guide plate joining it. An additional arc-shaped deflecting path with a connected upper horizontal guide path and with rollers and deflecting rollers associated with them for guiding a conveyor belt, is arranged at the top end of the vertical guide path.

9 Claims, 6 Drawing Sheets

DEVICE FOR VERTICALLY CONVEYING COINS

FIELD OF THE INVENTION

The present invention pertains to a device for vertically conveying coins.

BACKGROUND OF THE INVENTION

Devices for vertically conveying coins have been known as so-called coin lifts. Large amounts of sorted and unsorted coins from coin boxes, containers and bags are poured into larger receiving containers, and smaller or larger amounts of coins are conveyed vertically upward by means of a circulating screw conveyor or a circulating dredging conveyor, and they are discharged via a chute attached to the top end of the vertical conveying device. Conventional devices for vertically conveying coins are consequently used exclusively for transporting a larger amount of sorted or unsorted coins from a low plane, which is readily accessible to pouring in, to a higher level necessary for the further processing of the coins, and differences in height of 1 to 2 m can be spanned.

Thus, one disadvantage of the prior-art device for vertically conveying coins is the fact that the coins are discharged from the upper outlet of the vertical conveying device in the same manner in which they were introduced into the receiving container at the lower end. Further processing of the coins for the purposes of identifying their denomination, counting, sorting out foreign coins, or sorting coins according to classes of coins consequently takes place only in an additional coin counting and coin sorting machine of a known design, which is installed at the top end of the vertical conveying device. Another disadvantage is the fact that the prior-art coin lifts, especially the dredging conveyors, are bulky.

SUMMARY AND OBJECTS OF THE INVENTION

The primary object of the present invention is therefore to improve the device for vertically conveying coins such that processing of the coins, e.g., identification of the denomination, counting, sorting according to denomination and/or coin class, sorting out of foreign coins, etc., can also be performed along with the vertical conveying.

According to the invention, a device is provided for vertically conveying coins including a lower horizontal guide path, a vertical guide path, an approximately arc-shaped deflecting path connecting the lower horizontal guide path and the vertical guide path. Each of the path conveys the coins in a lying flat position. At least one conveyor belt is provided. Rollers are provided whereby the conveyor belt is led around the rollers. Deflecting rollers are arranged at space locations from the guide paths and the from the arc-shaped deflecting path. With this structure, an essentially constant conveying gap is formed by the thickness of the coins being conveyed between the guide paths and the deflecting paths and the conveyor belt. Means for feeding the coins, conveyed lying flat one by one, is arranged at the beginning of the lower horizontal guide path. Means for transferring the coins being conveyed is arranged at the top end of the vertical guide path. At the beginning of the lower horizontal guide path there is preferably provided means for identifying the denomination of the coins and for counting the coins, and or for presorting and conveying the coins according to denomination and/or for sorting out foreign coins. The end of the vertical guide path is formed by a dispenser hood with a coin guide plate joining it. An additional arc-shaped deflecting path with a connected upper horizontal guide path and with rollers and deflecting rollers associated with them for guiding a conveyor belt, is arranged at the top end of the vertical guide path. An upper sorting section with a conveyor belt, which is associated with the upper sorting section and extends above the upper guide path, is provided in the plane of the top side of the upper, horizontally guided conveyor belt. The upper sorting section preferably has means for identifying the denomination of and for counting the coins fed in and/or for sorting the coins according to denomination and/or for sorting out foreign coins. The upper horizontal guide path is arranged on a rear side of a plate at right angles to the vertical guide path, arranged on the front side of a plate, and is provided with respective upper and lower guide rails. The upper horizontal guide path is connected to a connection piece with two lateral guide rails, which connection pieces arranged at a angle of 45% The planes of the two plates are arranged offset from one another by an amount that is greater than the thickness of the coins to be conveyed. The upper conveyor belt is led around deflecting rollers with vertical axis on the rear side of the plate and is arranged in parallel to the upper horizontal guide path. The upper horizontal guide path is arranged at right angles to the vertical guide path with identical guide planes for the coins. A baffle plate for the coins, which is formed of a lug in the upper guide path and of a depression in the lower guide path, is arranged at the beginning of the upper horizontal guide path. The device for vertically conveying coins thus comprises a guide and deflecting path for conveying coins flat from a device arranged in the lower area of the device for conveying the coins, being conveyed lying flat, one by one to the device for transferring the coins, which is arranged at the top end of the vertical guide path. The vertical coin conveying device is consequently associated with a device for separating the coins, which are subsequently conveyed one by one and in a conveying position lying-flat to the upper transfer device via the horizontal and vertical guide path and via the deflecting path connecting those guide paths. Thus, the coins are being already processed already during conveying, because their denomination can be determined after separating, sorted according to coin classes or the types of coin, and they can be checked for the presence of foreign coins, and undesired coin classes, undesired coins and foreign coins can be sorted out already before the vertical conveying. Thus, the coins arriving at the top end of the vertical guide path in the transfer device will have been processed in the desired manner, i.e., their denomination has been identified and they have been counted and/or sorted according to denomination and coin classes.

The top edge of the vertical guide path is joined, in an especially preferred manner, by an upper, arc-shaped deflecting path with an upper horizontal guide path, which can be connected, and rollers and deflecting rollers for guiding a conveyor belt, of which there is at least one, are associated with the upper deflecting path and with the upper guide path. An additional guide path with a conveyor belt, which is associated with it and extends above the additional guide path, is provided in the plane of the top side of the conveyor belt, which is again led horizontally. In this embodiment, the coins can be conveyed via the vertical conveying means in a random sequence, and they are processed only in the upper area; foreign coins can be sorted out already at the beginning of the lower, horizontal guide path, and sorting according to denomination takes place only in the upper area of the horizontal guide path. It is possible here, e.g., to dispense coins of different denominations, i.e., 1-DM, 2-DM and 5-DM (or nickels, dimes, quarters, etc.) coins, separately.

The identification, counting, presorting of the coins, and the sorting out of foreign coins can take place in this preferred embodiment both at the bottom and at the top, or even at the bottom and at the top, so that dual function of the device is possible. Two completely separate systems for processing the coins, which are conveyed vertically upward between the two systems, are available in this embodiment. If one system breaks down, the other system continuous to function completely and independently.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 5:
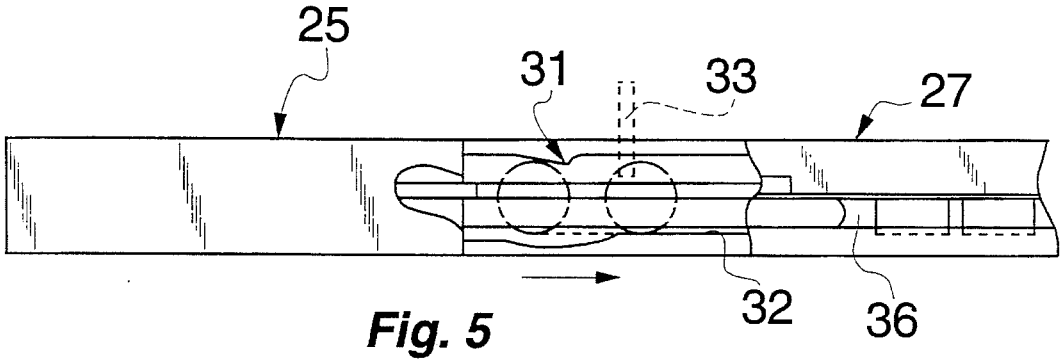
FIG. 5 is a top view of the upper guide path according to FIGS. 3 or 4.

Referring to the drawings in particular, the invention comprises a device for vertically conveying coins 2 comprises a coin tray 1 provided with a vibrator for feeding the sorted or unsorted coins 2 from coin boxes, containers or bags, a rotary table 3, which is connected to the coin tray 1 and rotates counterclockwise, with a switching lever 34 for determining the overfilling of the rotary table 3, a connected lower horizontal guide path 4, a vertical guide path 5, a quarter circle-shaped deflecting path 6 connecting the guide paths, and a conveyor belt 7. The lower horizontal guide path 4, the deflecting path 6, and the vertical guide path 5 is comprised of steel strip or another material, with guide rails, the distance between which is greater than the diameter of the largest of the coins 2 to be conveyed, being applied to them on both sides. Guides 9 are screwed onto the guide rails 8, and the distance between the inner edges of the guides 9 is shorter than the distance between the inner edges of the guide rails 8. A C- or U-shaped guide channel 10 is thus formed for the coins 2 between the guide paths 4, 5 as well as the deflecting path 6, the guide rails 8 and the guides 9.

Figure 2:
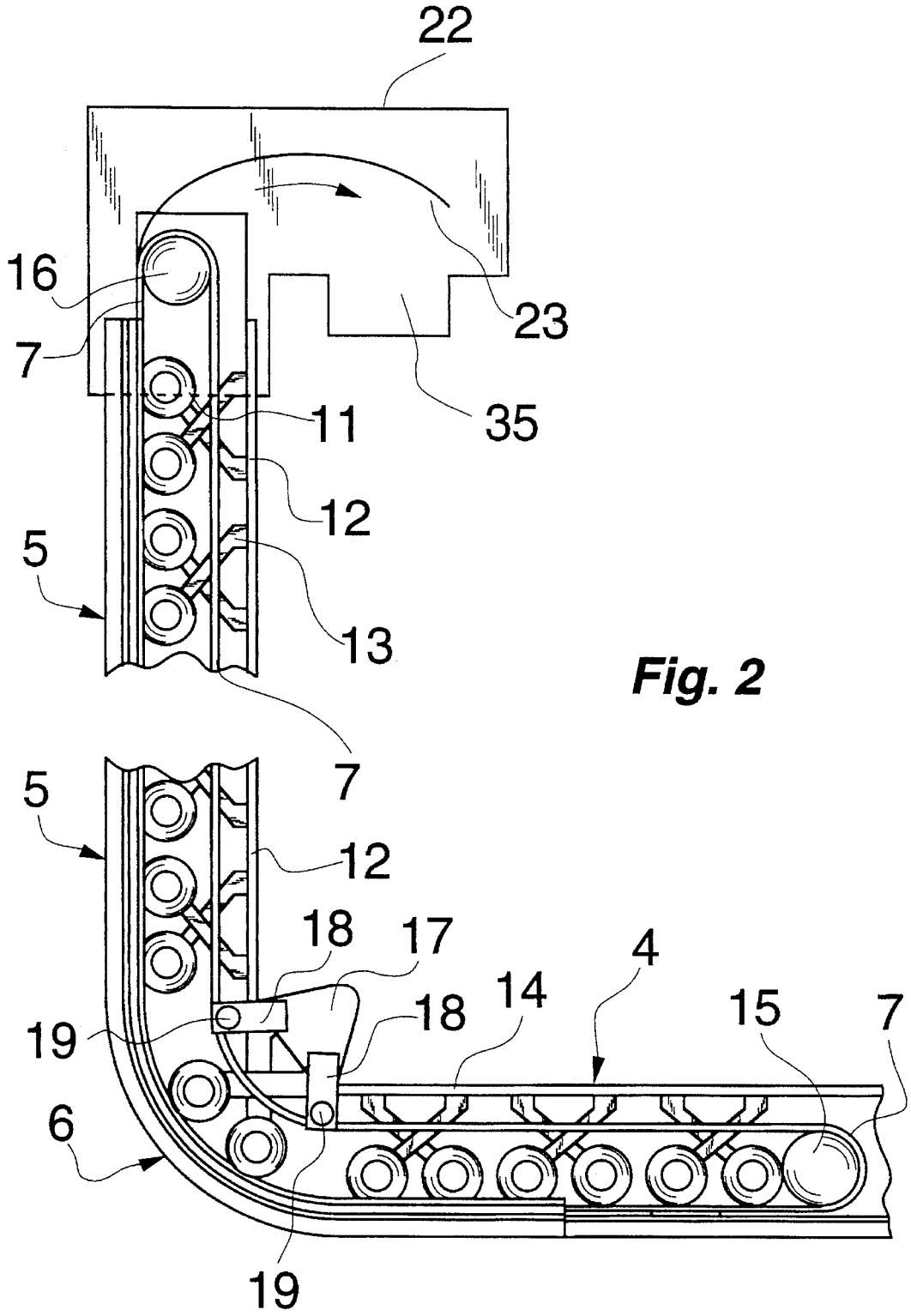
FIG. 2 is a side view of the first embodiment of the invention.

The conveyor belt 7, especially a toothed belt, is led between the guide rails 8 and the guides 9, and a number of rollers 11 are provided for this purpose; the rollers are mounted at the ends of the spring-loaded guide arms 13, which are fastened to vertical and horizontal frame parts 12, 14 and are connected to the horizontal and vertical guide paths 4, 5. The conveyor belt 7 is led around a deflecting roller 15 at the beginning of the lower horizontal guide path 7 and around another deflecting roller 16 at the top end of the vertical guide path 5, and the freely returning strand of the conveyor belt 7 is returned in parallel to the frame parts 12, 14. In the area of the deflecting path 6, two brackets 18 for double rollers 19 are linked to a wishbone 17, which is a rigid part of the frame, and the brackets 18 are pressed against the returning strand of the conveyor belt 7 from the outside, thus deflecting it by about 90 in the area of the quarter circle-shaped deflecting path 6, as is shown in FIG. 2.

The coins 2 fed from the rotary table 3 into the lower horizontal guide path 4, which is located in the same horizontal plane as the plane of the rotary table 3. The coins 2 pass by a ball bearing 20 at the beginning of the horizontal guide path 4 and a counting device 21, which is designed as a light scanning head, and the coins 2 are then fed into the lower horizontal guide path 4, and the coins 2 are then fed into the lower horizontal guide path 4, and the coins 2 are grasped by the lower strand of the conveyor belt 7 and are fed on the lower horizontal guide path 4 between the guide rails 8. Since the static friction between the conveyor belt 7 and the coins 2 is stronger than the sliding friction between the coins 2 and the guide paths 4, 5 as well as the deflecting path 6, the coins 2 are first guided almost slip-free, after which they are deflected into a vertical direction in the area of the quarter circle-shaped deflecting path 6, and they are then conveyed vertically in the upward direction along the vertical guide path 5, and the coins 2 are conveyed vertically to the top end of the vertical guide path 5 without problems due to the stronger static friction between the coin 2 and the conveyor belt 7 and due to the weaker sliding friction between the coin 2 and the guide paths and deflecting paths 4 through 6. A coin guide plate 23, which feeds the coins 2 to a coin dispenser 35 for further processing after the vertical upward conveying, is provided there within a dispenser hood 22 covering the top end of the vertical guide path 5.

Identification, counting, as well as presorting of the coins 2 can be performed by means of the counting device 21 in the area of the lower horizontal guide path 4, so that only 1-DM coins or 2-DM coins or 5-DM coins (or for example nickels, dimes and quarters) will be conveyed, whereas all the coins of the other two denominations are sorted out immediately. Using the counting device 21, it is possible to count a limit amount, e.g., 100 1-DM coins and to discharge them vertically. It is, of course, also possible to sort out the foreign coins identified by means of the counting device 21.

Figure 3:
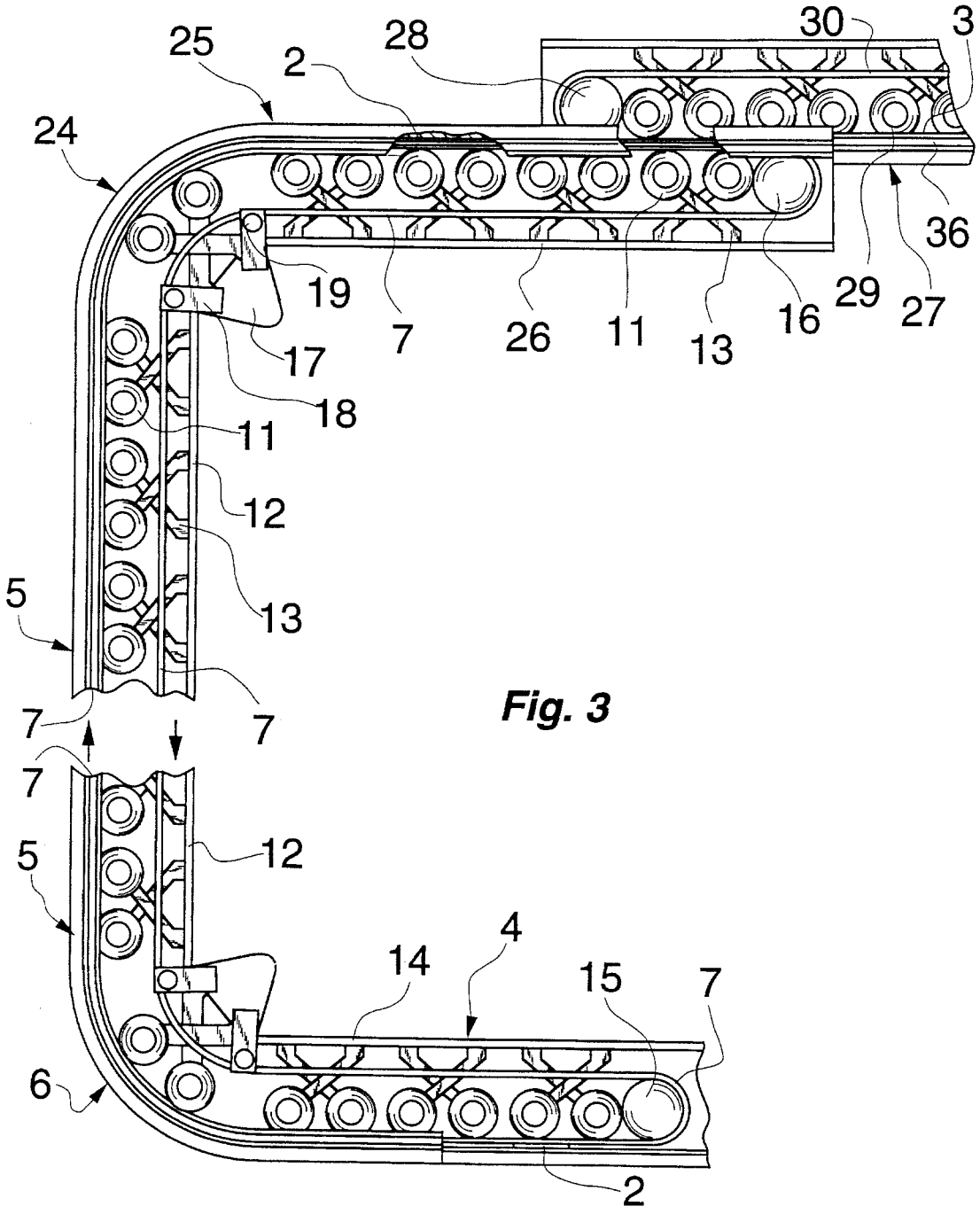
FIG. 3 is a side view of the second embodiment of the invention with a second, upper horizontal guide path.
Figure 4:
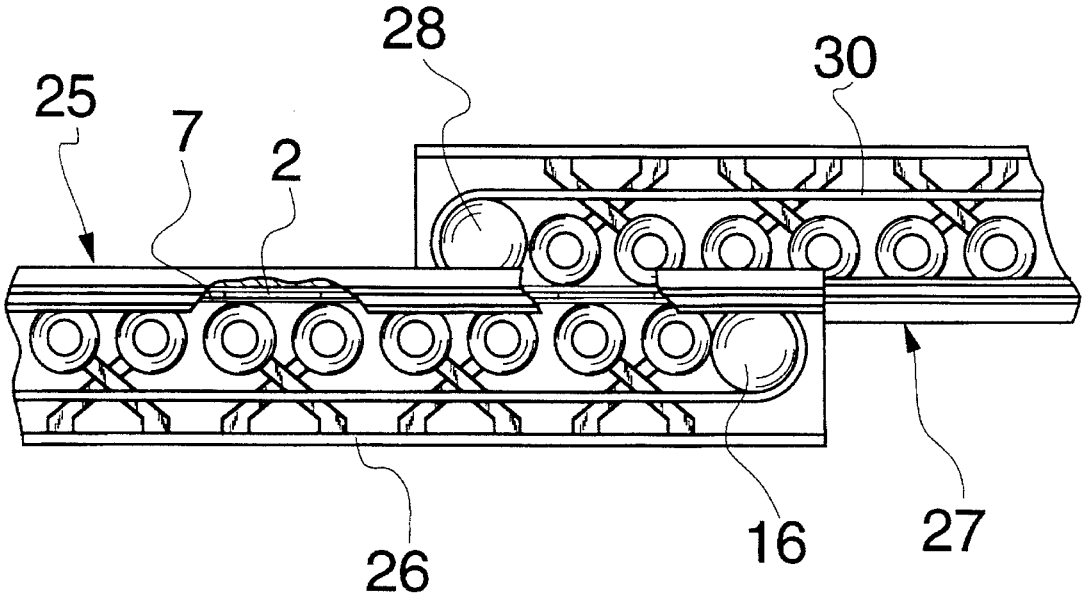
FIG. 4 is a detail from FIG. 3 on an enlarged scale.

In the second embodiment of the device for vertically conveying the coins 2, which is represented in FIGS. 3 through 5, the top end of the vertical guide path 5 is joined by another quarter circle-shaped deflecting path 24 with an upper horizontal guide path 25 joining it, and an wishbone 17 with the brackets 18 and the double rollers 19 for further deflection of the conveyor belt 7 is provided in the area of the deflecting path 24, whereas the upper deflecting roller 16 is displaced to the end of the upper horizontal guide path 25. The conveyor belt 7 is guided via the rollers 11 arranged in the area of the upper deflecting path 24 and of the upper horizontal guide path 25 in this area as well. The design of the upper deflecting path 24 corresponds to the design of the lower deflecting path 6. The design of the upper horizontal guide path 25 corresponds to the design of the lower horizontal guide path 4. Furthermore, an additional frame part 26 for holding the guide arms 13 for the rollers 11 is provided in the area of the upper horizontal guide path 25, and the upper frame part 26 is also mechanically securely connected to the upper horizontal guide path 25.

An upper sorting section 27 with an additional conveyor belt 30, which is led around the deflecting rollers 28 and is mounted by means of rollers 29, is arranged above the upper horizontal guide path 25 and in the end area of that the guide path 25, and the slide rail 36 of the upper sorting section 27 is slit in the longitudinal direction, and it accommodates the upper strand of the conveyor belt 7 of the upper horizontal guide path 25 in the slit, which is not shown in detail. The top side of the upper strand of the conveyor belt 7 of the upper horizontal guide path 25 and the top side of the slide rail 36 are located in the same plane. The coins 2 lying on the conveyor belt 7 are thus taken over onto the slide rail 36 of the upper sorting section 27 by means of the upper conveyor belt 30 at the end of the upper horizontal guide path 25. The coins 2 are taken over in the area of a baffle plate 31, which is represented in FIG. 5 and in which the inner side edges of the guide rails 8 extend so non-uniformly that the arriving coins 2 are pressed against a guide edge 32 of the upper sorting section 27 under the action of the upper conveyor belt 30. An additional identification device 33 for the coins 2 is provided there, so that the coins 2 can not only be identified, but also counted and presorted. A repeated sorting out of foreign coins and the presetting of a limit amount are possible.

Thus, the second embodiment represented in FIGS. 3 through 5 makes possible both the identification processing of the coins 2 in the area of the lower horizontal guide path 2 and a identification processing of the coins 2 in the area of the upper sorting section 27, as a result of which double safety of identification, counting, and sorting of the said coins 2 is achieved. If one of the identification systems fails, the other recognition system is still able to function completely.

Instead of a single conveyor belt 7 for the horizontal and vertical conveying of the coins 2, it is also possible to use a plurality of individual conveyor belts, each of which covers only a partial area of the guide paths, and the conveyor belts must overlap.

The deflection angles in the area of the quarter circle-shaped deflections 5, 24 may also be made smaller or greater than 90, instead of 90.

Figure 1:
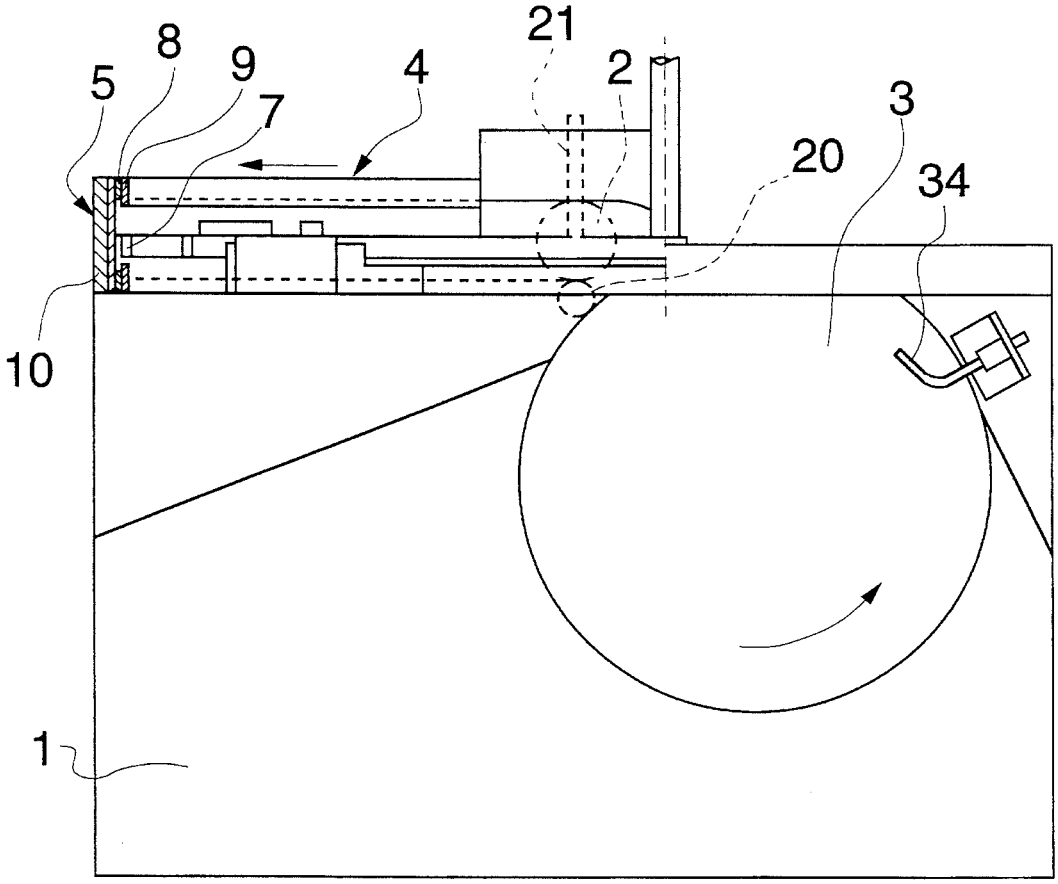
FIG. 1 is a top view of the lower horizontal guide path with the vertical guide path cut open.
Figure 6:
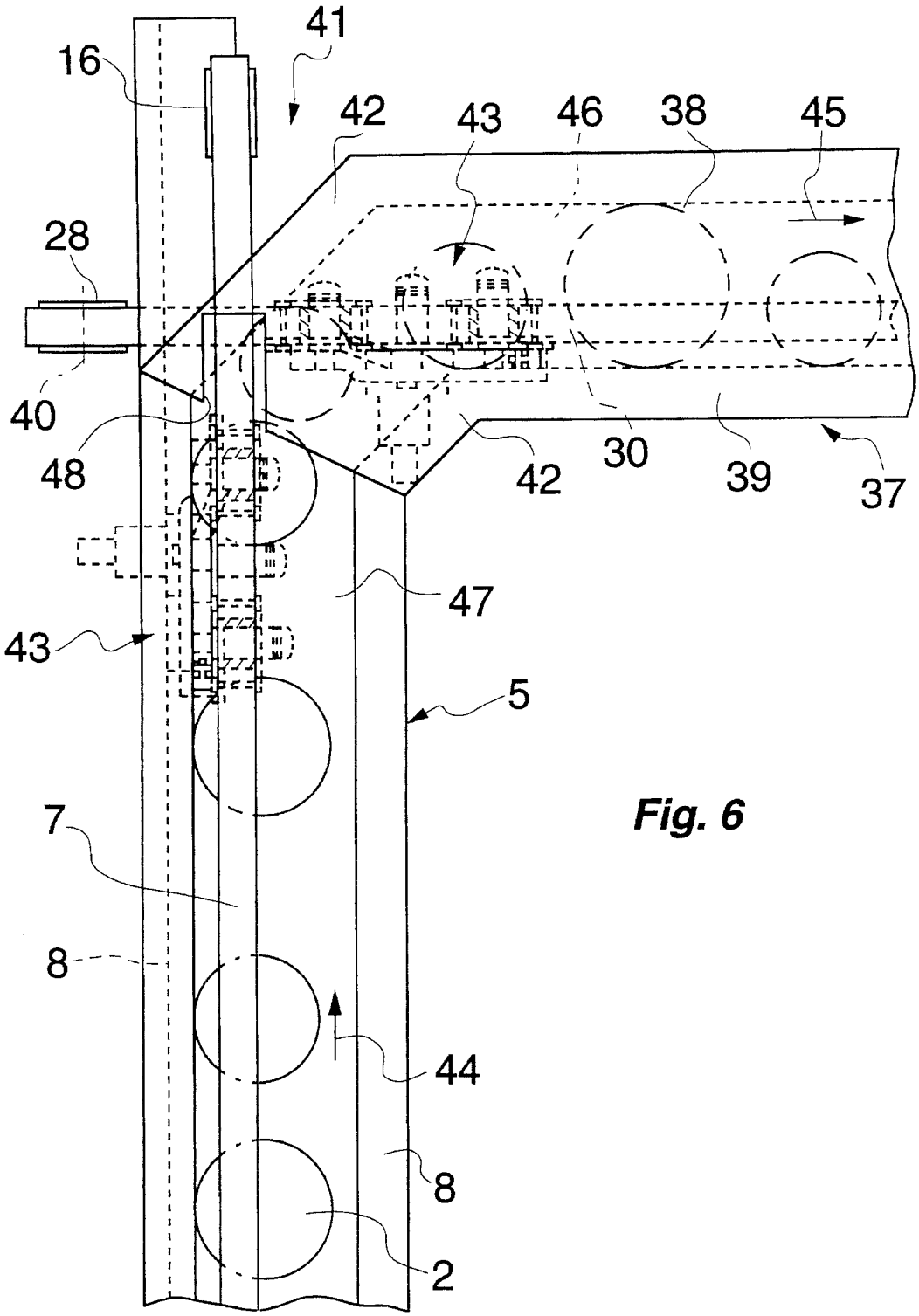
FIG. 6 is a side view of a top portion according to a third embodiment of the invention.

In the third embodiment shown in FIG. 6, the device for vertically conveying coins comprises, in the same manner as the first and second embodiments represented in FIGS. 1 through 5, the lower horizontal guide path 4 according to FIG. 1 with the coin tray 1 and the rotary table 3, as well as the vertical guide path 5 with two the lateral guide rails 8 and with the conveyor belt 7 running around the upper deflecting roller 16 for vertically conveying the coins 2 in the direction of the arrow 44 on the front side of the conveying path 5. In contrast to the second embodiment represented in FIGS. 3 through 5, the upper horizontal guide path 37 with its two edge-mounted guide rails 38, 39 in the third embodiment according to FIG. 6 also extends in the vertical direction, like the vertical guide path 5, but it is bent by an angle of 90 and is located on the rear side of a plate 46 forming the guide path 37, whereas the vertical guide path 5 is located on the front side of a plate 47. The plane of the upper guide path 37 is consequently arranged offset by a certain amount in relation to the plane of the vertical guide path 5, and this amount is greater than the thickness of the coins 2 to be conveyed. The coins 2 are thus transferred in the vertical direction from the front side of the guide path 5 to the rear side of the guide path 37, as shown by the broken lines in FIG. 6 and as will be explained in detail below.

On the rear side of the plate 47, the conveyor belt 30 is arranged in parallel to the upper horizontal guide path 37 and is led around two the deflecting rollers 28, which rotate around vertical axes 40, and it crosses the conveyor belt 7 on the front side of the vertical guide path 5. A connection piece 41, which is bent at 45 in relation to the vertical guide path 5 as well as the upper horizontal guide path 37, connects the vertical guide path 5 to the upper horizontal guide path 37, and the lateral guide rails 42 are designed and arranged as connection pieces bent at 45 between the vertical guide rails 8 on the front side of the guide path 5 and the horizontal guide rails 38, 39 on the rear side of the guide path 37. An incision 48 in the connection piece 41 makes it possible to guide the lower strand of the conveyor belt 7 without being hindered by the upper horizontal guide path 37. The direction of movement of the coins 2, which are being conveyed vertically in the upward direction by means of the conveyor belt 7, lying flat on the front side of the plate 47 of the vertical guide path 5 between the guide rails 8, can thus be deflected by 90 , and the coins 2 can be transferred to the upper horizontal guide path 37 with the upper conveyor belt 30, which conveys the coins 2 in the area of the upper horizontal guide path 37 on the rear side of the plate 46 along the lower guide rail 39 arranged there in the direction of the arrow 45, but in the upright, vertical position. Two pressing elements 43, which are provided with spring-loaded rollers, are arranged directly in front of the connection piece 41 and in the area of the connection piece 41, and the pressing elements 43 press the strand of the respective conveyor belt 7 and 30. This strand is directed toward the respective guide paths 5 and 37, against the continuously flat guide paths 5, 37, respectively, from the front side and from the rear side, respectively, so that the coins 2 being conveyed in the flat position between the lower strand and the respective guide paths 5, 37 are pressed on and are transferred by the vertical guide path 5 onto the upper horizontal guide path 37 in the vertical position. Means (not shown) for identifying the denomination of and for counting the coins (2) and/or for presorting and conveying the coins (2) according to denomination and/or for sorting out foreign coins are arranged at the end of the upper horizontal guide path 37.

Figure 7:
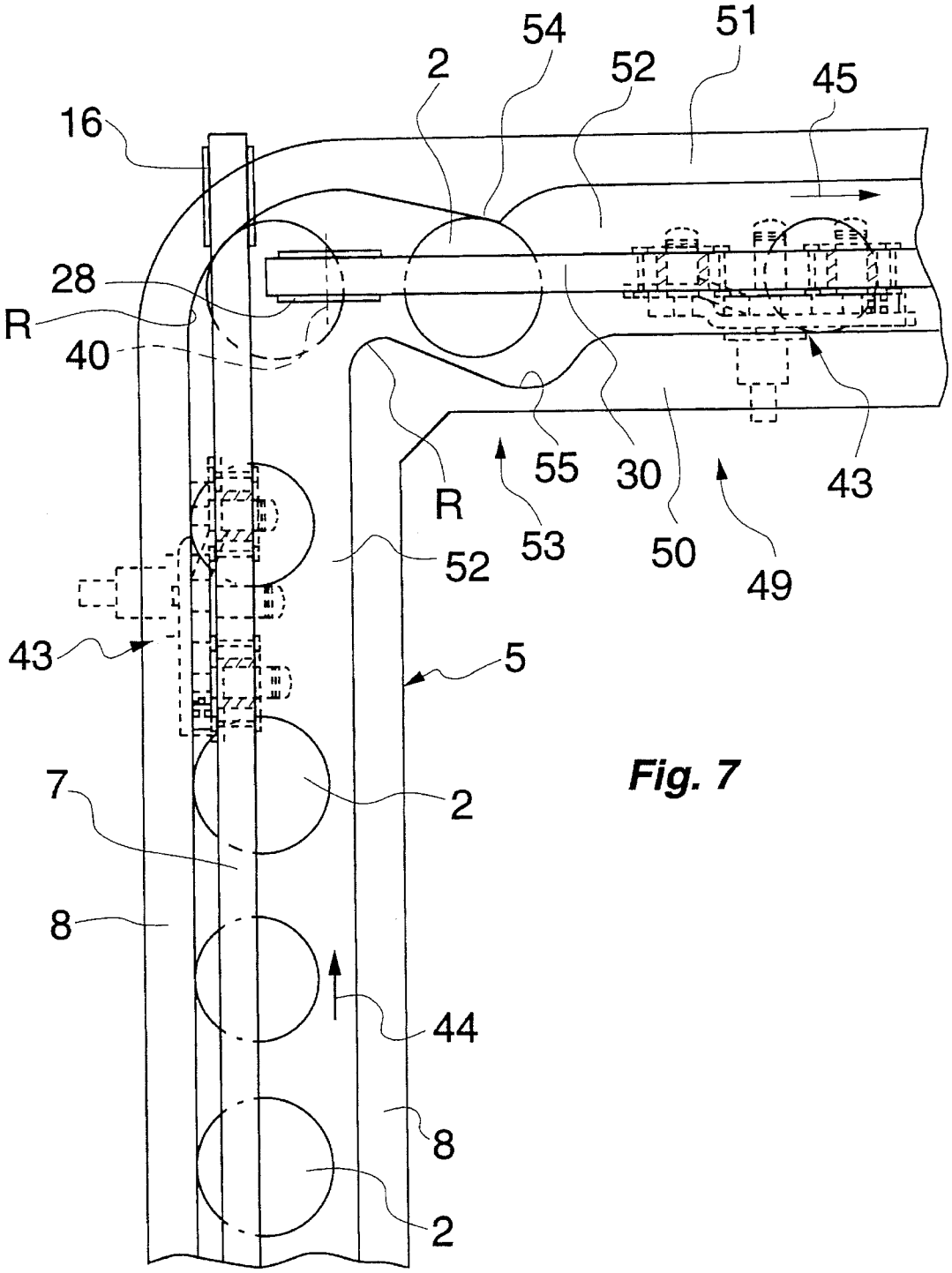
FIG. 7 is a side view of a top portion according to a fourth embodiment of the device.

The fourth embodiment of the device for vertically conveying the coins 2, which is shown in FIG. 7, has a same design similar to the design of the third embodiment represented in FIG. 6. The upper horizontal guide path 49 with its two edge-mounted guide rails 50, 51 also extends in the vertical direction, as does the vertical guide path 5, and it is bent by an angle of 90 , but it is located on the front side of a plate 52 forming the guide path 49, and the vertical guide path 5 is also located on the front side of the same plate 52.

The conveyor belt 30 is arranged around two deflecting rollers 28, in parallel to the upper horizontal guide path 49, on the front side of the plate 52. The deflecting rollers 28 rotate around the vertical axes 40, and one of them is arranged at a closely spaced location to the vertical conveyor belt 5 in order to guarantee reliable transfer of the coins 2. The two guide rails 8 of the vertical guide path 5 pass over into the respective lower and upper guide paths 50, 51 of the upper horizontal guide path 49, and a large radius of curvature R on the outer side and a small radius of curvature r on the inner side lead over into the upper guide path 51 and into the lower guide path 50, respectively. A baffle plate 53 (see the baffle plate 31 in FIG. 5), which consists of a lug 54, which interrupts the upper guide path 51 and is directed toward the lower guide path 50, and of a depression 55, which is located opposite it (the lug, is located behind the radii R, r in the direction of movement of the coins 2 according to the arrow 45). The baffle plate 53 is used to press the coins 2 being conveyed on the vertical conveyor belt 5 along the radius R—immediately after they have been transferred to the upper horizontal conveyor belt 30—against the lower guide rail 50 of the upper horizontal guide path 49, in order for the coins 2 to find there a reference edge, which is necessary for the further processing of the coins.

The pressing elements 43, comprising spring-tensioned pressing rollers, are arranged at the top end of the vertical guide path 5 and at the beginning of the upper horizontal guide path 49, directly behind the baffle plate 53, in order to press the respective lower strand of the conveyor belts 7, 30 against the guide paths 5 and 49, respectively.

Using the four embodiments of the present invention, the coins 2 can be conveyed at the top end of the vertical guide path 5 either to the front or to the rear, lying flat, or to the left or to the right, standing on edge. Further conveying and/or counting of the coins 2 is thus possible in any position.

While specific embodiments of the invention have been shown and described in detail to illustrate the application of the principles of the invention, it will be understood that the invention may be embodied otherwise without departing from such principles.

What is claimed is:

1. A device for vertically conveying coins, comprising:

a lower horizontal guide path;

a vertical guide path;

an approximately arc-shaped deflecting path connecting said horizontal guide path and said vertical guide path for conveying the coins in a flat lying position;

deflecting rollers positioned at spaced apart locations;

a conveyor belt led around said deflecting rollers;

positioning roller means including rollers positioned at spaced location from said horizontal guide path, from said vertical guide path and from said arc-shaped deflecting path to position said conveyor belt for defining a substantially constant conveying gap formed by a thickness of coins being conveyed between said horizontal guide path and said belt, between said vertical guide path and said belt and between said arc-shaped deflecting and said conveyor belt;

an additional arc-shaped deflecting path and an upper horizontal guide path connected to said additional arc-shaped deflecting path, said upper horizontal guide path including upper deflecting rollers, an upper conveyor belt supported by said upper deflecting rollers and support rollers for supporting said upper conveyor belt, said additional arc-shaped deflecting path being arranged at a top end of said vertical guide path;

an upper sorting section with an upper sorting section conveyor belt extending above said upper guide path, in a plane of a top side of said upper conveyor belt;

feeding means for conveying coins in a flat lying position, one by one to said conveying gap, said feeding means being arranged at a beginning of said lower horizontal guide path, said feeding means including identification mean for identifying denominations and for counting the coins; and transfer means for transferring coins being conveyed from a top end of said vertical guide path, said transfer means including a dispenser hood with a coin guide plate joining said dispenser hood.

2. A device according to claim 1, wherein said feeding means further includes one of:

means for presorting and conveying the coins according to denomination; and means for sorting out foreign coins.

3. A device according to claim 1, further comprising:

identification means for identifying a denomination and for counting coins and/or for sorting coins according to denomination and/or for sorting out foreign coins is provided with said upper sorting section.

4. A device according to claim 1, further comprising:

a plate having a rear side, said upper horizontal guide path being arranged on said rear side of said plate at right angles to said vertical guide path, said vertical guide path being arranged on a front side of said plate, said upper horizontal guide path having an upper guide rail and having a lower guide rail;

a connection piece with two lateral guide rails, said upper horizontal guide path being connected to said connection piece, said connection piece being arranged at an angle of 45°, said first plate and said second plate having planes offset from one another by an amount that is greater than a thickness of the coins to be conveyed;

said upper conveyor belt being led around said upper deflecting rollers on a rear side of said first plate and being arranged and parallel to said upper horizontal guide path.

5. A device according to claim 1, wherein said upper horizontal guide path is arranged at right angles to said vertical guide path, said upper horizontal guide path having an identical guide plane for the coins to be conveyed.

6. A device according to claim 5, further comprising:

a baffle plate including a lug, said baffle plate being positioned in said upper guide path and including a depression in a lower guide path arranged at a beginning of said upper horizontal guide path.

7. Device for vertically delivering coins, comprising:

a lower horizontal guide;

a vertical guide;

an upper horizontal guide;

approximately arc-shaped deflection portions connecting said lower horizontal guide to said vertical guide and connecting said lower horizontal guide and said vertical guide to said upper horizontal guide, said guides and deflection portions defining guide paths with guide rails, the rails being arranged on both sides of said guide paths, spaced a distance which is greater than a diameter of the largest coins to be delivered;

feeding means for feeding the coins flatly one by one at the beginning of the lower horizontal guide;

transferring means for transferring the coins at the end of the upper horizontal guide;

a conveyor belt and rollers, said conveyor belt being guided around said rollers, said rollers being arranged at a spaced location from said deflection portions to define an essentially constant delivery gap of a thickness of the coins to be delivered; and coin counting means for counting the coins for recognizing the value of and for counting the coins and/or for presorting and delivering the coins according to value and/or for sorting out foreign coins, said coin counting means being provided at the beginning of said lower horizontal guide and at the end of said upper horizontal guide.

8. A device according to claim 7, wherein:

said upper horizontal guide is arranged at right angles to said vertical guide, said upper horizontal guide having an identical guide plane for the coins to be conveyed.

9. A device according to claim 8, further comprising:

a baffle plate including a lug, said baffle plate being positioned in said upper guide and including a depression in a lower guide arranged at a beginning of said upper horizontal guide.

* * * * *